US011305325B2

(12) United States Patent
Harada et al.

(10) Patent No.: US 11,305,325 B2
(45) Date of Patent: Apr. 19, 2022

(54) PROCESSING METHOD FOR METAL PLATE

(71) Applicant: Kanemitsu Corporation, Akashi (JP)

(72) Inventors: Kunihiro Harada, Akashi (JP); Akifumi Hagino, Akashi (JP); Takeshi Kakiuchi, Akashi (JP)

(73) Assignee: KANEMITSU CORPORATION, Akashi (JP)

( * ) Notice: Subject to any disclaimer, the term of this patent is extended or adjusted under 35 U.S.C. 154(b) by 484 days.

(21) Appl. No.: 16/244,215

(22) Filed: Jan. 10, 2019

(65) Prior Publication Data

US 2019/0232350 A1 Aug. 1, 2019

(30) Foreign Application Priority Data

Jan. 26, 2018 (JP) ..... JP2018-011620

(51) Int. Cl.

| | |
|---|---|
| ***B21D 22/02*** | (2006.01) |
| ***B21D 51/02*** | (2006.01) |
| ***B21D 22/24*** | (2006.01) |
| ***B21D 22/26*** | (2006.01) |
| ***B21D 22/04*** | (2006.01) |

(52) U.S. Cl.

CPC ..... *B21D 22/02* (2013.01); *B21D 22/04* (2013.01); *B21D 22/24* (2013.01); *B21D 22/26* (2013.01); *B21D 51/02* (2013.01)

(58) Field of Classification Search

CPC ..... B21D 22/02; B21D 22/04; B21D 22/24; B21D 22/26; B21D 24/005; B21D 13/02; B21D 13/06; B21D 13/08; B21D 35/002; B21D 51/02; B21D 13/10; B21D 22/06

See application file for complete search history.

(56) References Cited

U.S. PATENT DOCUMENTS

| | | | | |
|---|---|---|---|---|
| 3,587,285 | A * | 6/1971 | Gonzalez | B21D 22/02 72/266 |
| 9,044,801 | B2 * | 6/2015 | Golovashchenko | B21D 24/16 |
| 2016/0332205 | A1 * | 11/2016 | Nakazawa | B21D 22/26 |

FOREIGN PATENT DOCUMENTS

| | | |
|---|---|---|
| JP | 2015-071395 | 4/2015 |

* cited by examiner

*Primary Examiner* — Teresa M Ekiert

(74) *Attorney, Agent, or Firm* — Rankin, Hill & Clark LLP

(57) ABSTRACT

A processing method for a metal plate includes a curve surface forming recess forming step, a protruding step, and a shaping and dividing step. In the curve surface forming recess forming step, a recess is formed in the metal plate, the recess having an outer periphery forming a curve surface, a side portion formed in a frustum, and a bottom portion being round. In the protruding step, a portion of the recess from the bottom portion to the side portion is protruded toward an inside of the recess, and the side portion of the recess is formed to be close to a center of the recess. In the shaping and dividing step, the protruded portion and the outer periphery of the recess are shaped so that the recess is divided into a group of the plural recess portions adjacent to each other.

6 Claims, 4 Drawing Sheets

PROCESSING METHOD FOR METAL PLATE

BACKGROUND OF THE INVENTION

(1) Field of the Invention

The present invention relates to a processing method for a metal plate.

(2) Description of Related Art

Japanese Patent Application Laid-open No. 2015-71395 discloses a forming method for a base plate. In the forming method, a material having a predetermined thickness to be a base material of the base plate is firstly cut into a circular plate. The circular plate is subjected to drawing (first drawing). The drawing is achieved by performing press forming using a known method. In the press forming, a forming die and a forming punch having an outer diameter slightly smaller than an inner diameter of the forming die are used. A blank diameter of the material after the first drawing is approximately 60% of the original outer diameter. Thereafter, similarly to the processing described above, the drawing is repeated while the inner diameter of the forming die and the outer diameter of the forming punch are gradually reduced. After that, an outer periphery of the material in a radial direction is subjected to outer diameter drawing in order to form a bowl shape. Further, detail forming (drawing or ironing) of each part is performed.

According to the forming method for the base plate disclosed in Japanese Patent Application Laid-open No. 2015-71395, different parts of a gas generator are formed from one base material through the press forming. With this, a procedure can be simplified and a cost can be reduced compared to a conventional construction that requires machining for finishing.

SUMMARY OF THE INVENTION

However, in the invention disclosed in Japanese Patent Application Laid-open No. 2015-71395, in a case in which adjacent recess portions are formed on the metal plate, a plate thickness between the adjacent recess portions is easily reduced.

An object of the present invention is to provide a processing method for a metal plate, in a case in which adjacent recess portions are formed on the metal plate, the processing method for the metal plate being capable of suppressing reduction in a plate thickness between the adjacent recess portions.

In order to achieve the object described above, according to one aspect of the present invention, a processing method for a metal plate includes plural recess portions forming step S100. In plural recess portions forming step S100, a group of plural recess portions 222 adjacent to each other is formed in the metal plate. Plural recess portions forming step S100 includes curve surface forming recess forming step S120, protruding step S122, and shaping and dividing step S124. In curve surface and recess forming step S120, a recess 220 is formed in the metal plate 200. The recess 220 has an outer periphery 230 forming a curve surface, a side portion 232 between the outer periphery 230 and a bottom portion 234 formed in a frustum, and the bottom portion 234 being round. In protruding step S122, a predetermined portion from the bottom portion 234 to the side portion 232 of the recess 220 formed in curve surface and recess forming step S120 is protruded toward an inside of the recess 220, and a portion of the side portion 232 of the recess 220 that is not protruded is formed to be close to a center of the recess 220. In shaping and dividing step S124, the portion protruded toward the inside of the recess 220 formed in protruding step S122 and the outer periphery 230 of the recess 220 are shaped so that the recess 220 formed in curve surface forming recess forming step S120 is divided into a group of the plural recess portions 222 adjacent to each other.

In protruding step S122, the predetermined portion from the bottom portion 234 to the side portion 232 of the recess 220 formed in the metal plate 200 in curve surface forming recess forming step S120 is protruded toward the inside of the recess 220. Together with this, a portion of the side portion 232 of the recess 220 that is not protruded is formed to be close to the center of the recess 220. Since the portion is formed to be close to the center of the recess 220, a material shortage of the portion caused by protruding the predetermined portion of the recess 220 toward the inside of the recess 220 is compensated. Since the material shortage is compensated, reduction in a plate thickness between the recess portions 222 adjacent to each other caused by the material shortage can be suppressed.

Further, in protruding step S122 described above, it is preferable that the portion of the recess 220 protruded toward the inside is protruded to form a pair of partitions 240, 240 extending from a center of the protruded portion in directions opposite to each other. In this case, it is preferable that parts separated by the partitions 240, 240 to face each other, in the portion of the recess 220 that is not protruded, are formed to be close to the center of the recess 220.

The portion of the recess 220 protruded toward the inside is protruded to form a pair of the partitions 240, 240 extending from the center of the protruded portion in directions opposite to each other. The parts separated by the partitions 240, 240 to face each other, in the portion of the recess 220 that is not protruded, are formed to be close to the center of the recess 220. With this, forces for forming the portions of the recess 220 that is not protruded to close to the center are easily balanced compared to a configuration in which parts of the side portion 232 of the recess 220 different from each other are formed to be close to in directions different from each other. Since the forces are balanced, a possibility of generation of unexpected deformation of the metal plate 200 caused by a part of the force for processing the metal plate 200 can be decreased.

According to the present invention, in a case in which the adjacent recess portions are formed in the metal plate, the reduction in the plate thickness between the adjacent recess portions can be suppressed.

DETAILED DESCRIPTION OF PREFERRED EMBODIMENTS

Hereinafter, an embodiment of the present invention will be described with reference to drawings. In the description below, the same reference signs are assigned to the same parts. The name and function of the same parts are the same as each other. Accordingly, the detailed description thereof will not be repeatedly described.

[Configuration of Pressing Machine]

A not-shown pressing machine according to the present embodiment is similar to a well-known pressing machine. Accordingly, the detailed description thereof is not repeatedly described. A die according to the present embodiment is attached to the pressing machine according to the present embodiment. A processing method for a metal plate 200 according to the present embodiment is performed by the pressing machine. The die according to the present embodiment is described below.

[Processing Method of Metal Plate]

Figure 1:
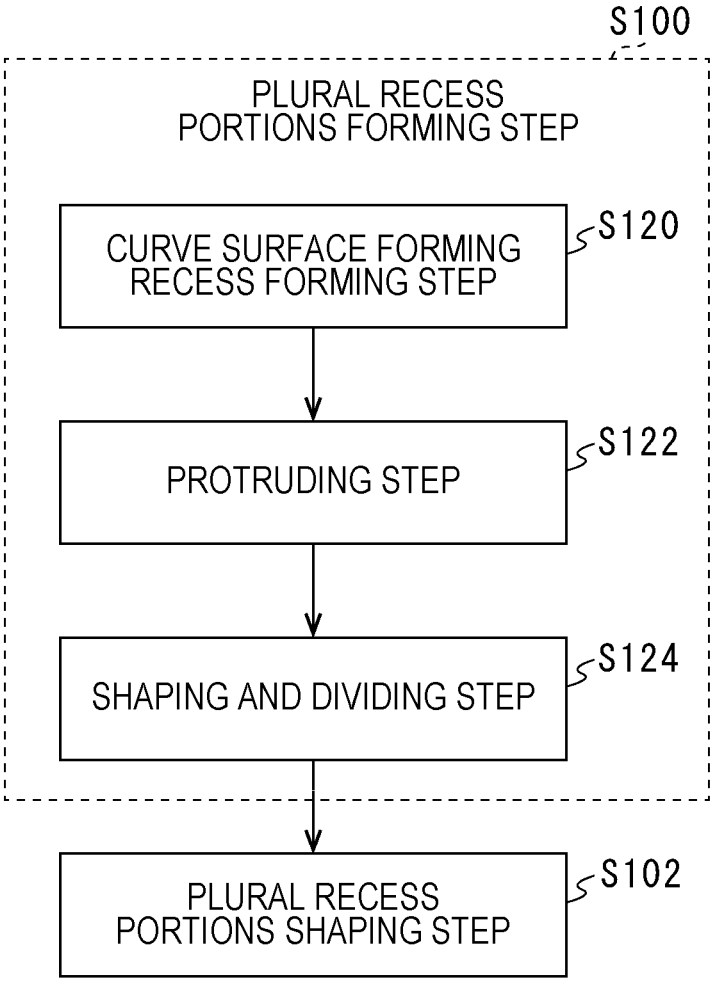
FIG. 1 is a diagram illustrating a procedure of a processing method for a metal plate according to one embodiment of the present invention.
Figure 2:
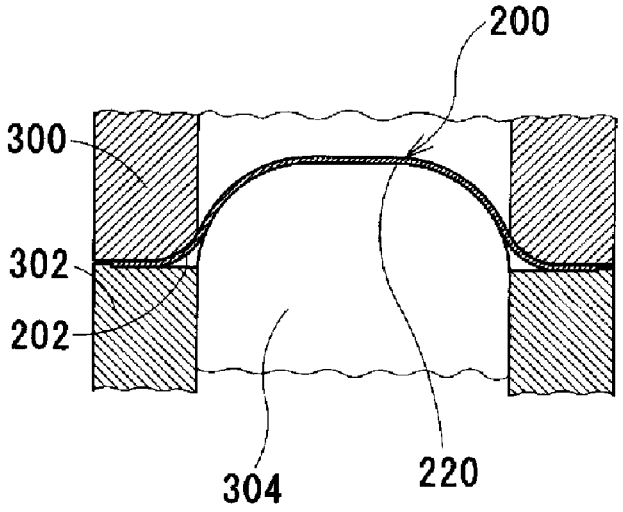
FIG. 2 is a conceptual view illustrating a processing state of the metal plate in a curve surface forming recess forming step according to the one embodiment of the present invention.
Figure 3:
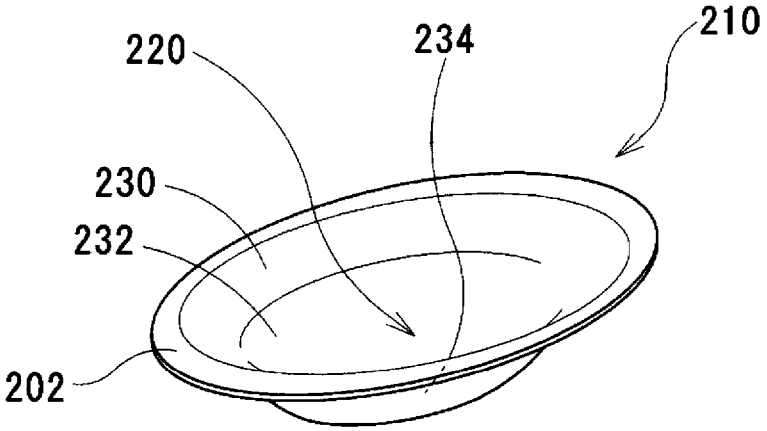
FIG. 3 is an external view of a semi-processed product after the curve surface forming recess forming step according to the one embodiment of the present invention.
Figure 4:
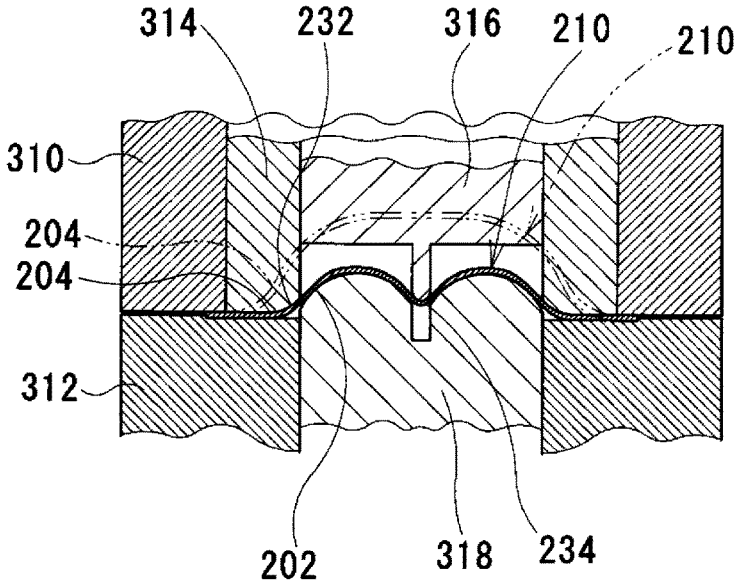
FIG. 4 is a conceptual view of a processing state of the semi-processed product in a protruding step according to the one embodiment of the present invention.
Figure 5:
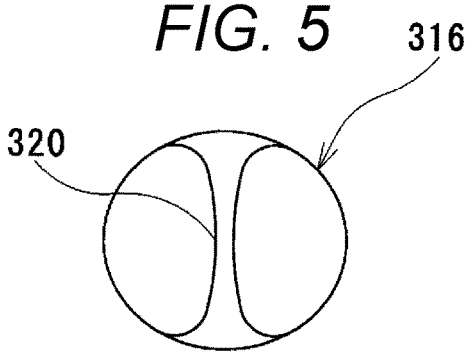
FIG. 5 is an external view of a rear side male die seen from a front side in the protruding step according to the one embodiment of the present invention.
Figure 6:
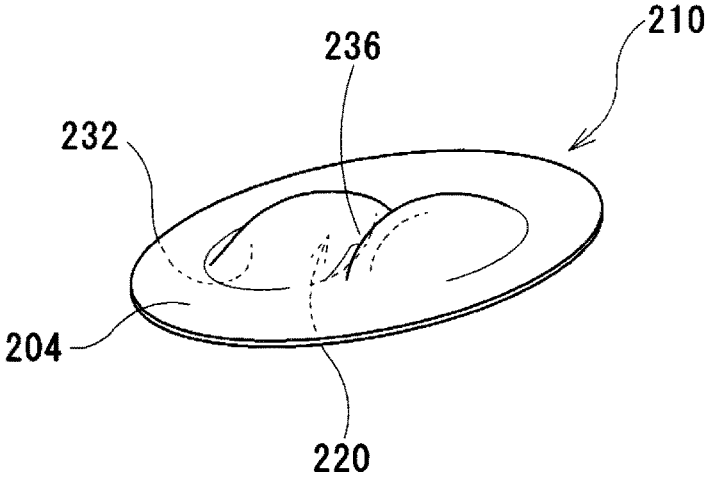
FIG. 6 is an external view of the semi-processed product after the protruding step according to the one embodiment of the present invention.
Figure 7:
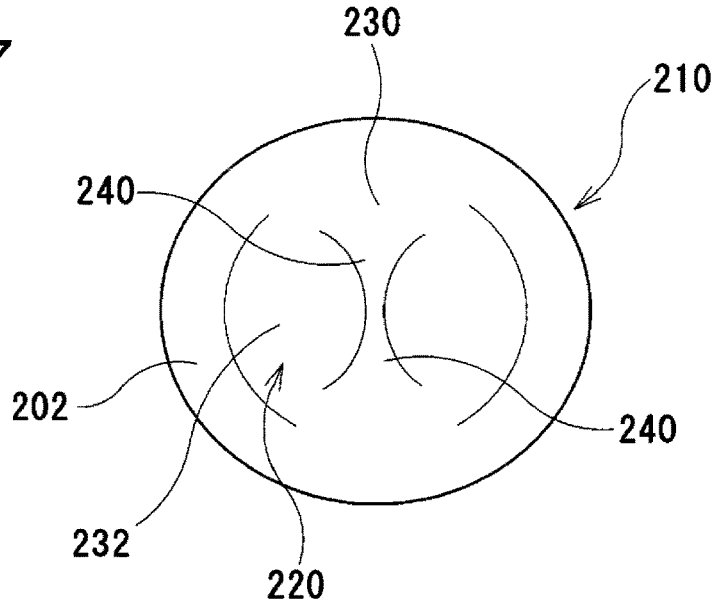
FIG. 7 is a plan view of the semi-processed product after the protruding step according to the one embodiment of the present invention.
Figure 8:
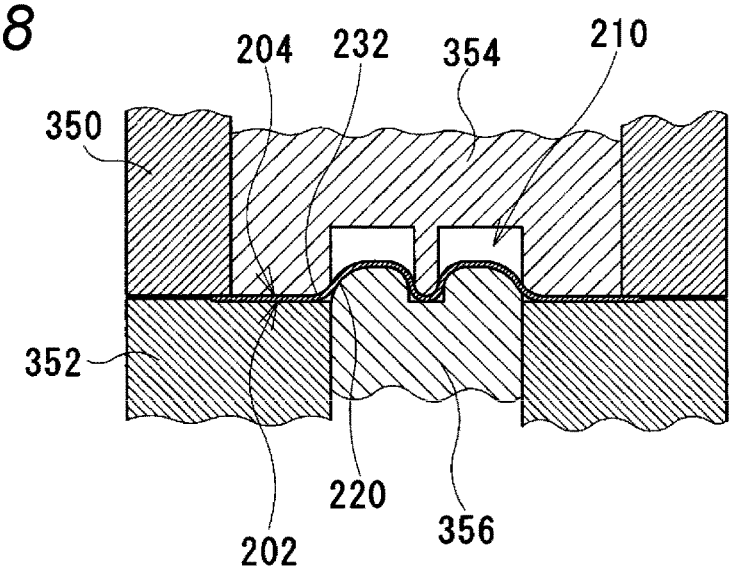
FIG. 8 is a conceptual view illustrating a processing state of the semi-processed product in a shaping and dividing step according to the one embodiment of the present invention.
Figure 9:
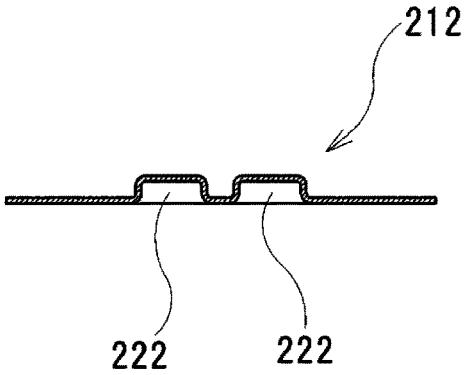
FIG. 9 is a cross-sectional view of a processed product according to the one embodiment of the present invention.

FIG. 1 is a diagram illustrating a procedure of the processing method for the metal plate 200 according to the present embodiment. FIG. 2 is a conceptual view illustrating a processing state of the metal plate 200 in curve surface forming recess forming step S120 according to the present embodiment. FIG. 3 is an external view of a semi-processed product 210 after curve surface forming recess forming step S120 according to the present embodiment. FIG. 4 is a conceptual view of a processing state of the semi-processed product 210 in protruding step S122 according to the present embodiment. FIG. 5 is an external view of a rear side male die 316 seen from a front side in protruding step S122 according to the present embodiment. FIG. 6 is an external view of the semi-processed product 210 after protruding step S122 according to the present embodiment. FIG. 7 is a plan view of the semi-processed product 210 after protruding step S122 according to the present embodiment. FIG. 8 is a conceptual view illustrating a processing state of the semi-processed product 210 in shaping and dividing step S124 according to the present embodiment. FIG. 9 is a cross-sectional view of a processed product 212 according to the present embodiment. Hereinafter, the processing method for the metal plate 200 according to the present embodiment is described with reference to FIG. 1 to FIG. 9.

The processing method for the metal plate 200 according to the present embodiment includes plural recess portions forming step S100 and plural recess portions shaping step S102.

In plural recess portions forming step S100, a group of plural recess portions 222 adjacent to each other is formed in the metal plate 200. Consequently, the metal plate 200 is turned into the semi-processed product 210.

In the present embodiment, plural recess portions forming step S100 includes curve surface forming recess forming step S120, protruding step S122, and shaping and dividing step S124.

In curve surface forming recess forming step S120, an operator operates the not-shown pressing machine so as to fix the metal plate 200 by a female die 300 and a holding die 302. Next, the operator operates the pressing machine so as to press a male die 304 onto a front surface 202 of the metal plate 200 as shown in FIG. 2. Consequently, the recess 220 is formed in the front surface 202 of the metal plate 200. When the recess 220 is formed, the metal plate 200 is turned into the semi-processed product 210. As shown in FIG. 3, an outer periphery 230 of the recess 220 of the semi-processed product 210 forms a curve surface. A side portion 232 of the recess 220 is formed in a frustum. The side portion 232 is a portion between the outer periphery 230 and a bottom portion 234. The bottom portion 234 of the recess 220 also forms a curve surface.

In protruding step S122, the operator operates the pressing machine described above so as to fix the semi-processed product 210 by a first holding die 310 and a second holding die 312 as shown in FIG. 4. Next, the operator operates the pressing machine described above so as to press a rear side female die 314 onto a rear surface 204 of the semi-processed product 210.

In association with the pressing of the rear side female die 314, the operator operates the pressing machine described above so as to press a rear side male die 316 onto the rear surface 204 of the semi-processed product 210. At the same time, the operator presses a front side male die 318 onto the front surface 202 of the semi-processed product 210.

As shown in FIG. 5, a distal end 320 of the rear side male die 316 is extended linearly and a width of both ends of the distal end 320 is wider than a width of a center portion of the distal end 320. This can be recognized that the distal end 320 of the rear side male die 316 is formed to radially protrude from the center thereof to the both ends. When the rear side male die 316 is pressed onto the rear surface 204 of the semi-processed product 210, the center portion from the bottom portion 234 to the side portion 232 of the recess 220 is protruded toward an inside of the recess 220. As a result, as shown in FIG. 6, a groove 236 is formed in a portion corresponding to a rear surface of the recess 220 on the rear surface 204 of the semi-processed product 210.

As obvious from the description described above, in curve surface forming recess forming step S120, the center portion from the bottom portion 234 to the side portion 232 of the recess 220 is protruded toward the inside of the recess 220. As shown in FIG. 7, the protruded portion is linearly extended. This portion can be also recognized to be protruded to form a pair of partitions 240, 240 respectively extending in directions opposite to each other from the center of this portion. On the other hand, portions of the outer periphery 230 and the side portion 232 of the recess 220 of the semi-processed product 210 separated by the partitions 240, 240 to face each other are formed to be close to the center of the recess 220.

In shaping and dividing step S124, as shown in FIG. 8, the operator fixes the semi-processed product 210 by a first holding die 350 and a second holding die 352. Next, the operator operates the pressing machine described above so as to press a female die 354 onto the rear surface 204 of the semi-processed product 210. Consequently, the side portion 232 of the recess 220 of the semi-processed product 210 is formed to be further close to the center of the recess 220. Next, the operator presses a male die 356 onto the front surface 202 of the recess 220 of the semi-processed product 210.

The female die 354 includes two holes adjacent to each other. The male die 356 includes two protrusions facing the two holes respectively. The recess 220 is fitted into the two holes of the female die 354 and the two protrusions of the male die 356 facing the two holes respectively are pressed onto the recess 220 so that the recess 220 is divided into a group of two recess portions 222 adjacent to each other. Further, the two recess portions 222 adjacent to each other are each shaped.

In plural recess portions shaping step S102, each form of the two recess portions 222 adjacent to each other formed in plural recess portions forming step S100 is shaped. A specific configuration of this step is similar to that of a well-known step for shaping each form of the plural recess portions 222 adjacent to each other. Accordingly, the detailed description thereof is not repeatedly described. When this step is finished, as shown in FIG. 9, the semi-processed product 210 is turned into the processed product 212 including the two recess portions 222.

Effects of the Processing Method for the Metal Plate According to the Present Embodiment According to the processing method for the metal plate 200 according to the present embodiment, the center portion from the bottom portion 234 to the side portion 232 of the recess 220 formed in the metal plate 200 in curve surface forming recess forming step S120 is protruded toward the inside of the recess 220 in protruding step S122. Together with this, the both side parts of the side portions 232 of the recess 220 are formed to be close to the center of the recess 220. Since the both side parts are formed to be close to the center of the recess 220, a material shortage of the center portion caused by protruding the center portion of the recess 220 into the inside of the recess 220 is compensated. Since the material shortage is compensated, reduction in a plate thickness between the recess portions 222 adjacent to each other caused by the material shortage can be suppressed.

The embodiment disclosed above is exemplarily described in all points. The scope of the present invention is not limited to the embodiment described above and therefore it is obvious that the embodiment can be modified in any manner within the subject matter of the present invention.

For example, in protruding step S122, the distal end 320 of the rear side male die 316 is not limited to the configuration described above. The distal end of the rear side male die 316 described above may be formed in a configuration including a portion having a plate shape extending in directions opposite to each other from the center. An example of such a configuration includes a cross shape. In a case in which a predetermined portion of the recess 220 of the semi-processed product 210 is protruded by the front side male die having such a distal end, the predetermined portion forms a pair of partitions extending in directions opposite to each other from the center. Of course, the distal end 320 of the rear side male die 316 described above is not limited to the configuration including the portion having the plate shape extending in the directions opposite to each other from the center.

What is claimed is:

1. A method for processing a metal plate comprising:

a first step including using a first die set to form a recess in the metal plate, the recess having an outer periphery, a bottom, and a side extending between the outer periphery and the bottom, wherein the recess forms a curved surface;

a second step including using a second die set, which is different from the first die set, a) to form a protrusion in the metal plate, the protrusion extending up into the recess, and b) to press a portion of the side, that is not part of the protrusion, toward a center of the recess; and a third step of forming a plurality of recesses in the metal plate, the third step including using a third die set, which is different from the first die set and from the second die set, a) to extend the protrusion further up into the recess, and b) to press the portion of the side further towards the center of the recess, wherein the plurality of recesses are formed adjacent to each other on the metal plate and are separated by the protrusion.

2. The method according to claim 1, wherein in the second step, the recess is partitioned into two sections by the protrusion.

3. The method according to claim 2, wherein the third step includes:

fitting the two sections of the recess into adjacent holes of a female die of the third die set, and pressing projections of a male die of the third die set into the two sections of the recess and into the holes of the female die.

4. The method according to claim 3, wherein the two sections of the recess include the outer periphery of the recess.

5. The method according to claim 1, wherein the second step includes pressing a rear side female die of the second die set onto a rear surface of the recess, and pressing a rear side male die of the second die set onto the rear surface.

6. The method according to claim 5, wherein the second step includes pressing a front side male die of the second die set onto a front surface of the recess when the rear side male die is pressed onto the rear surface.

* * * * *